US008273516B2

(12) United States Patent
Wosnick et al.

(10) Patent No.: US 8,273,516 B2
(45) Date of Patent: Sep. 25, 2012

(54) TONER COMPOSITIONS

(75) Inventors: Jordan H. Wosnick, Toronto (CA); Karen Ann Moffat, Brantford (CA)

(73) Assignee: Xerox Corporation, Norwalk, CT (US)

( * ) Notice: Subject to any disclaimer, the term of this patent is extended or adjusted under 35 U.S.C. 154(b) by 447 days.

(21) Appl. No.: 12/500,941

(22) Filed: Jul. 10, 2009

(65) Prior Publication Data

US 2011/0008722 A1 Jan. 13, 2011

(51) Int. Cl.
*G03G 9/08* (2006.01)

(52) U.S. Cl. ..... 430/109.3; 430/110.2

(58) Field of Classification Search ..... 430/109.3, 430/110.2

See application file for complete search history.

(56) References Cited

U.S. PATENT DOCUMENTS

| | | | | |
|---|---|---|---|---|
| 2,874,063 | A | | 2/1959 | Greig |
| 3,590,000 | A | | 6/1971 | Palermiti et al. |
| 3,800,588 | A | | 4/1974 | Larson et al. |
| 4,265,990 | A | | 5/1981 | Stolka et al. |
| 4,298,672 | A | | 11/1981 | Lu |
| 4,338,390 | A | | 7/1982 | Lu |
| 4,563,408 | A | | 1/1986 | Lin et al. |
| 4,584,253 | A | | 4/1986 | Lin et al. |
| 4,858,884 | A | | 8/1989 | Harwath |
| 5,346,797 | A | | 9/1994 | Kmiecik-Lawrynowicz et al. |
| 5,364,729 | A | | 11/1994 | Kmiecik-Lawrynowicz et al. |
| 5,403,693 | A | | 4/1995 | Patel et al. |
| 5,418,108 | A | | 5/1995 | Kmiecik-Lawrynowicz et al. |
| 5,501,935 | A | | 3/1996 | Patel et al. |
| 5,527,658 | A | | 6/1996 | Hopper et al. |
| 5,573,881 | A | * | 11/1996 | Kawasaki et al. ..... 430/108.8 |
| 5,585,215 | A | | 12/1996 | Ong et al. |
| 5,650,255 | A | | 7/1997 | Ng et al. |
| 5,650,256 | A | | 7/1997 | Veregin et al. |
| 5,853,943 | A | | 12/1998 | Cheng et al. |
| 6,214,507 | B1 | | 4/2001 | Sokol et al. |
| 6,632,883 | B2 | | 10/2003 | Mayes et al. |
| 7,132,491 | B2 | | 11/2006 | Lo et al. |
| 2007/0073000 | A1 | | 3/2007 | Mayes et al. |
| 2007/0092823 | A1 | | 4/2007 | Matsumura et al. |
| 2008/0009586 | A1 | * | 1/2008 | VanSumeren et al. ..... 525/88 |
| 2008/0038650 | A1 | | 2/2008 | Bender et al. |

OTHER PUBLICATIONS

Juan A. Gonzalez-Leon, et al., "Low-temperature processing of 'baroplastics' by pressure-induced flow", *Nature*, vol. 426, pp. 424-428 (2003).

Juan A. Gonzalez-Leon, et al., "Core-Shell Polymer Nanoparticles for Baroplastic Processing", *Macromolecules*, vol. 38, pp. 8036-8044 (2005).

* cited by examiner

*Primary Examiner* — Mark A Chapman

(57) ABSTRACT

Toners are provided which include a resin including at least one baroplastic polymer. The baroplastic polymer, in embodiments, may be a block copolymer with discrete low glass transition temperature (Tg) domains and high Tg domains that plasticize one another at ambient temperature when subjected to pressures of from about 500 psi (about 3.45 MPa) to about 10,000 psi (about 69 MPa), enabling them to be extruded and molded without heat. The resulting polymers, in turn, may then be utilized to form toners.

11 Claims, No Drawings

TONER COMPOSITIONS

BACKGROUND

The present disclosure relates generally to toners and toner processes, and more specifically, to processes for producing toners that can be fused at reduced temperatures, thereby permitting significant energy savings.

Numerous processes are within the purview of those skilled in the art for the preparation of toners, such as, for example, conventional processes wherein a resin is melt kneaded or extruded with a pigment, micronized, and pulverized to provide toner particles. Toner can also be produced by emulsion aggregation methods. Methods of preparing an emulsion aggregation (EA) type toner are within the purview of those skilled in the art, and toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners include those illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

Methods for reducing the energy required for fusing or melting toners to a substrate, and thus reducing energy costs, are desirable. To date, within the electrophotographic printing area, one strategy has been the development of ultra-low melt (ULM) polyester-based EA toners that are based on a mixture of a crystalline polymer and a glassy amorphous polymer. These toners can be fused at lower temperatures than conventional toners, resulting in significant energy savings. Additional benefits of ultra-low melt toner technology include the potential for faster print speeds, faster start-up times, and reduced fuser wear.

Despite these advances, energy consumption in electrophotographic printing is still dominated by the fusing subsystem, which is responsible for a significant portion of the power required by an electrophotographic printer.

Hence, toner compositions produced with decreased energy requirements during printing that perform similar to conventional toners remain desirable.

SUMMARY

The present disclosure provides toners and processes for making such toners. In embodiments, a toner of the present disclosure may include a baroplastic resin including a block copolymer including at least one soft segment in combination with at least one hard segment; and one or more ingredients such as colorants, waxes, coagulants, and combinations thereof.

In other embodiments, a toner of the present disclosure may include a latex resin including a block copolymer such as styrene acrylates, styrene butadienes, styrene methacrylates, and combinations thereof; and one or more ingredients such as colorants, waxes, coagulants, and combinations thereof.

A process of the present disclosure may include providing a block copolymeric composition including a soft component A having a $T_g$ of less than 20° C., a hard component B in contact with the soft component A, the hard component having a $T_g$ such that hard component has negligible flow at room temperature; contacting the block copolymeric composition in a dispersion with an optional colorant, an optional surfactant, and an optional wax to form small particles; aggregating the small particles; coalescing the small particles to form toner particles; recovering the toner particles; applying the toner particles to a substrate; and applying a pressure of at least about 100 psi to the block copolymeric composition such that the block copolymeric composition exhibits Newtonian flow at a processing temperature less than about 150° C., wherein the composition does not exhibit Newtonian flow at the processing temperature in the absence of said pressure.

DETAILED DESCRIPTION

The present disclosure provides baroplastic polymers as base materials for cold-pressure fixable toners. Such polymers include, for example, those disclosed in U.S. Pat. No. 6,632,883 and U.S. Patent Application Publication No. 2007/0073000, the disclosures of each of which are hereby incorporated by reference in their entirety, in addition to those disclosed by Mayes et al., Macromolecules 2005, vol. 38, pp. 8036-8044, and Mayes et al., Nature 2003, vol. 426, pp. 424-428.

Toners of the present disclosure may include a baroplastic polymer resin in combination with a pigment. The baroplastic polymer resin may be combined with a pigment and other optional additives to form toner particles utilizing any method within the purview of those skilled in the art, including emulsion aggregation methods. Emulsion aggregation involves aggregation of both submicron latex and pigment particles into toner size particles, where the growth in particle size is, for example, in embodiments from about 0.1 micron to about 15 microns.

Where any list of materials or components is provided herein, it is contemplated that a single material, multiple items of a single material, which may be the same or different, or any possible combinations of the listed materials, may be utilized.

Resin

As used herein, a "baroplastic material" is a material which, at a set temperature and a particular applied pressure, is much more readily processable than in the absence of that pressure, for example, a composition that is processed primarily by applying a pressure rather than by heating. As used herein, in embodiments, "processable" includes the ability to bring about a change in a material's shape, form, properties, characteristics, combinations thereof, and the like. In embodiments, the baroplastic material is not processable under ambient pressures and temperatures (about 1 atmosphere ("atm") and 25° C., respectively), but becomes processable upon the application of various pressures (for example, at least about 100 pounds per square inch ("psi"), in some embodiments at least about 300 psi, in other embodiments at least about 1000 psi, in still other embodiments at least about 3000 psi, in still other embodiments at least about 5000 psi, and in still other embodiments at least about 7500 psi). A baroplastic material is processable, at a particular pressure, at a temperature significantly lower than would be expected given similar pressure applied to a non-baroplastic material. That is, relative to processing of a single homogeneous material (e.g., polyethylene), at which processing temperature may vary slightly based upon applied pressure, the processing temperature of a baroplastic material may be significantly reduced upon application of similar pressure. In some cases, a baroplastic material may become processable upon the application of a pressure at a temperature at which, in the absence of the pressure, the baroplastic material would remain unprocessable, for example, at temperatures below the glass transition temperature of the material at 1 atm, and/or at temperatures below about 100° C., below about 75° C., below about 50° C., or at temperatures near room temperature (about 25° C.).

In embodiments, "baroplastic materials" may be able to attain a miscible state by applying a particular pressure. By "miscible state", it is meant that the domains are absent or of negligible size. For block copolymers, the miscible state is also known as the "disordered" state. A transition from an ordered state to a disordered state is known as an "order-disorder transition," and a transition from a disordered state to an ordered state is known as a "disorder-order transition." In embodiments, a polymer may exhibit Newtonian flow required for processing conditions when the polymer is in a miscible state and above the $T_g$ and $T_m$ of the polymer. Thus, in this miscible state, the polymer composition can be processed due to its flowable nature. In one embodiment, upon the application of pressure (in embodiments at least about 100 psi) the polymer composition can be processed at a temperature less than about 150° C., in embodiments less than about 100° C., in other embodiments less than about 60° C. These temperatures define temperatures measurable at the surface of the polymer composition during processing. While the copolymer possesses Newtonian flow at these temperatures upon the application of pressure, the copolymer does not exhibit Newtonian flow, i.e., has negligible flow, at processing temperatures, or at room temperature, in the absence of these pressures.

In embodiments, the miscibility of the polymer, especially a hard segment of the copolymer, may possess a pressure coefficient that favors miscibility, which may be described as a change in temperature of the disorder-order transition, $T_{DOT}$, of the block copolymer, as a function of change in pressure, P(d $T_{DOT}$/dP), of the block copolymer. In embodiments, this miscibility may have an absolute value greater than about 30° C./kbar.

In embodiments, the densities of the components of the polymer may be related to one another such that one block has a density at least about 0.94 times the density of the second block, and no more than about 1.06 times the density of the second block.

Any monomer for forming a baroplastic polymer may be utilized in forming a resin for a toner. Suitable monomers useful include, but are not limited to, styrenes, acrylates, methacrylates, butadienes, isoprenes, acrylic acids, methacrylic acids, acrylonitriles, combinations thereof, and the like, as well as diols, diacids, diamines, lactones, lactams, carbonates, and diisocyanates.

In embodiments, the resin utilized to form a toner of the present disclosure may include at least one polymer. In embodiments, at least one may be from about one to about twenty and, in embodiments, from about three to about ten. In embodiments, the baroplastic polymer may be a block copolymer. In embodiments the polymer may be poly(pentadecalactone), poly(pentadecenlactone), poly(hexadecenlactone), poly(caprolactone), poly(ethylene brassylate), and/or combinations thereof.

In embodiments, a poly(styrene-block-butyl acrylate) may be utilized as the polymer. As noted above, the baroplastic polymer may be a block copolymer possessing discrete blocks of the monomers utilized to form the copolymer. The bulk glass transition temperature of this polymer may be from about 35° C. to about 75° C., in embodiments from about 40° C. to about 70° C.

One aspect of the present disclosure provides a polymeric composition. In one embodiment, the polymeric composition is a polymer blend, i.e. a physical mixture of two or more polymers. In another embodiment, the polymeric composition is a block copolymer, including at least two blocks. For example, a block copolymer having a block of A monomers and a block of B monomers can have the formula:

$$-(A)_x-(B)_y—$$

wherein x and y can be the same or different and each represents an integer great enough to cause microphase separation at service or use temperatures, i.e., a temperature the article is to be used at (typically, room temperature). The blocks can be arranged in essentially any order or sequence, for example block $(A)_x$ can be bonded at one chain end to a block of $(B)_y$. A short form of this formula is also denoted here as A-b-B where "b" indicates the bond between blocks. The block copolymer can also be a tri-block or tetra-block, etc.

The block copolymers can have any block molecular architecture. Examples include A-b-B diblock copolymers, A-b-B-b-C triblock copolymers, $(A\text{-}b\text{-}B)_n$ star block copolymers, A-g-B graft-type copolymers, and other copolymer architectures, provided the characteristics of the block copolymer of interest match the thermodynamic, $T_g$ (glass transition temperature) and $T_m$ (melt temperature) criteria outlined herein.

At a temperature above $T_g$ or $T_m$, due to a net repulsion between the block components, block copolymers self-assemble at the molecular level where "like" blocks aggregate to form domains, i.e. a domain (typically of nanometer dimensions) of one type of block is positioned adjacent to a domain of a second type of block. Such domain formation results in a "phase separated" state, which can provide block copolymers with mechanical properties ranging from hard, tough plastics to flexible rubbers at service temperatures (e.g., such as room temperature), depending on composition choices. Unfortunately, phase separation also results in extremely high viscosities, necessitating either the use of solvents, low molecular weight blocks, and/or even higher processing temperatures to access the disordered (or phase-mixed) state of the copolymer. Access to the disordered state is necessary for processing the polymer (such as thermoforming, injection molding, coating, or other processes in which the polymer must be changed from one shape to a very different shape).

The present disclosure includes methods including providing a polymeric composition comprising at least one soft component A having a $T_g$ of from about −100° C. and about 20° C., and at least one hard component B in contact with the soft component A, the hard component having a $T_g$ of from about 20° C. and about 150° C., such that hard component(s) have negligible flow at room temperature (around 23° C.). Thus, at room temperature, the hard block(s) are either in a glassy state or a crystalline state. The method further comprises the step of applying a pressure of at least about 100 psi such that the polymeric composition exhibits Newtonian flow at a temperature of less than 150° C.

In embodiments, at use temperature (for example room temperature), the polymer composition exhibits a phase separated state. For the case of a A-b-B block copolymer, the phase separated state may also be referred to herein as the "ordered" state, having local domains of A and B of sizes (e.g. mean diameter or mean thickness) from about 1 to 500 nm, preferably from about 1 to 100 nm.

In embodiments, the particle may be chosen to have a maximum dimension on the length scale of polymer chains that form the domains of the particle. In other cases, the minimum diameter of the particle may be at least about 1 nm, and in other cases, the domains may have a smallest dimension of at least about 2 nm, at least about 3 nm, at least about 5 nm, at least about 7 nm, at least about 10 nm, at least about 15 nm, at least about 20 nm, at least about 30 nm, at least about 40 nm, at least about 50 nm, at least about 75 nm, at least about 100 nm, at least about 200 nm, at least about 300 nm, at least about 500 nm, at least about 750 nm, or at least about 1000 nm or more in some cases.

Stabilizers

In embodiments, it may be advantageous to include a stabilizer when forming the copolymer. Suitable stabilizers include monomers having carboxylic acid functionality. Such stabilizers may be of the following formula (I):

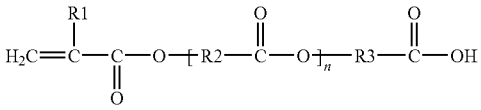

(I)

where R1 is hydrogen or a methyl group; R2 and R3 are independently selected from alkyl groups containing from about 1 to about 12 carbon atoms or a phenyl group; n is from about 0 to about 20, in embodiments from about 1 to about 10. Examples of such stabilizers include beta carboxyethyl acrylate (β-CEA), poly(2-carboxyethyl)acrylate, 2-carboxyethyl methacrylate, combinations thereof, and the like. Other stabilizers which may be utilized include, for example, acrylic acid or methacrylic acid and its derivatives.

In embodiments, the stabilizer having carboxylic acid functionality may also contain a small amount of metallic ions, such as sodium, potassium and/or calcium, to achieve better emulsion polymerization results. The metallic ions may be present in an amount from about 0.001 to about 10 percent by weight of the stabilizer having carboxylic acid functionality, in embodiments from about 0.5 to about 5 percent by weight of the stabilizer having carboxylic acid functionality.

Where present, the stabilizer may be added in amounts from about 0.01 to about 5 percent by weight of the copolymer, in embodiments from about 0.05 to about 3 percent by weight of the copolymer.

In embodiments, an example of a baroplastic material suitable for use in forming a toner may thus include a tri-block co-polymer including polystyrene, poly(butyl acrylate), and optionally poly(beta-carboxyethyl acrylate), in discrete blocks. This co-polymer could be prepared from the appropriate monomers using any stable free-radical polymerization method, such as reversible addition-fragmentation chain transfer (RAFT) as disclosed in U.S. Pat. No. 7,132,491, the disclosure of which is hereby incorporated by reference in its entirety, atom transfer radical polymerization (ATRP) as disclosed in U.S. Pat. No. 6,759,491, the disclosure of which is hereby incorporated by reference in its entirety, and/or nitroxide mediated radical polymerization (NMRP) as disclosed in U.S. Patent Application Publication No. 2008/0038650, the disclosure of which is hereby incorporated by reference in its entirety.

In accordance with the present disclosure, the baroplastic polymers include discrete low glass transition temperature (Tg) domains and high Tg domains that plasticize one another at ambient temperature when subjected to pressures of from about 500 psi (about 3.5 MPa) to about 10,000 psi (about 69 MPa), in embodiments from about 1000 psi (about 3.5 MPa) to about 7,000 psi (about 48 MPa), in embodiments about 5,000 psi (about 35 MPa), enabling them to be extruded and molded without heat.

In embodiments, a first block of a baroplastic copolymer may be a soft component having a Tg of from about −100° C. to about 20° C., in embodiments from about −60° C. to about 0° C., with at least one other block of a baroplastic copolymer as a hard component having a $T_g$ of from about 20° C. to about 150° C., in embodiments from about 35° C. to about 100° C.

In embodiments, the resulting co-polymer may self-assemble in water to form core-shell nanoparticles in which the core includes polystyrene (having a Tg of about 100° C.), surrounded by an inner shell of poly(butyl acrylate) (having a $T_g$ of about −54° C.) and a thin outer layer or shell of poly (beta-carboxyethyl acrylate), which may provide the particles with a negative surface charge. In other embodiments, the positions of the components may be interchanged such that the resulting co-polymer may self-assemble in water to form core-shell nanoparticles in which the core includes poly (butyl acrylate) surrounded by an inner shell of polystyrene and a thin outer layer or shell of poly(beta-carboxyethyl acrylate).

In other embodiments, the polymer utilized to form the latex may be a polyester resin, including copolyesters formed by the ring-opening polymerization of a lactone or dilactone such as lactide, glycolide, caprolactone, a substituted caprolactone derivative, pentadecalactone, pentadecenelactone, hexadecenelactone, and combinations thereof. In embodiments, other copolymers which may be utilized include polyolefins produced by ring-opening metathesis polymerization, such as poly(cyclopentene), poly(cyclooctene), poly(norbornene), poly(dicyclopentadiene), combinations thereof, and the like.

The resulting core-shell particles may have a size of from about 10 nm to about 200 nm, in embodiments from about 50 nm to about 100 nm.

In embodiments, the polymer may be a copolymer including at least two distinct material domains, where a first domain contains a soft component with a relatively lower glass transition temperature and the second domain contains a hard component with a relatively higher glass transition temperature, as defined above. As a non-limiting example, if the composition is a particle having a core/shell arrangement as previously described, the core may have a relatively lower glass transition temperature and the shell may have a relatively higher glass transition temperature. In another arrangement, this relationship is reversed (shell having a lower glass transition temperature over a core having a higher glass transition temperature) with an auxiliary, outer shell having a higher glass transition temperature. Additional layers can be provided as well in the spirit of the present disclosure. In embodiments, the glass transition temperatures of the two domains may be selected such that one of the domains has a glass transition temperature less than the service temperature, while the second domain may has a glass transition temperature higher than the service temperature. As used herein, the "service temperature" is the temperature at which the final product will be used. For example, the service temperature may be room temperature (about 25° C.). In another embodiment, both domains may have glass transition temperatures higher than the final service temperature.

Thus, in certain embodiments, one domain may comprise a polymer having a $T_g$ less than room temperature (a "soft" component), while the second domain may comprise a polymer having a $T_g$ or $T_m$ greater than room temperature (a "hard" component, i.e., the polymer has negligible flow at room temperature). For example, the hard polymer may be in a glassy or a crystalline state. Soft and hard polymers may be selected or screened in some cases from known or measured $T_g$ values, as is known by those of ordinary skill in the art. As a non-limiting example, if the composition is a particle having a core/shell arrangement, the core may comprise a soft polymer, while the shell may comprise a hard polymer, or vice versa.

Individual nanoparticles of baroplastic polymers can be synthesized and/or dispersed in water and formed into toner using a standard EA process. This toner would be fixable using pressures similar to those that could be utilized in plasticizing or molding the resin, i.e., from about 500 psi (about 3.5 MPa) to about 10,000 psi (about 69 MPa), in embodiments from about 1000 psi (about 3.5 MPa) to about 7,000 psi (about 48 MPa), in embodiments about 5,000 psi (about 35 MPa). The processes of the present disclosure are environmentally friendly, dramatically reducing power consumption during the process of mechanically fixing the toner particles to the page.

Surfactants

In embodiments, the copolymer resin described above may be prepared in an aqueous phase containing a surfactant or co-surfactant. Surfactants which may be utilized with the resin to form a latex dispersion can be ionic or nonionic surfactants in an amount of from about 0.01 to about 15 weight percent of the solids, and in embodiments of from about 0.1 to about 10 weight percent of the solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, combinations thereof, and the like. In embodiments a suitable cationic surfactant includes SANISOL B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, combinations thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be utilized.

The choice of particular surfactants or combinations thereof, as well as the amounts of each to be used, are within the purview of those skilled in the art.

After formation of the above resin nanoparticles, the resin nanoparticles may be utilized to form a toner. The resulting nanoparticles could be incorporated as the base resin in a toner using an aggregation/coalescence process.

In embodiments, the toners may be an emulsion aggregation type toner that are prepared by the aggregation and fusion of the resin nanoparticles of the present disclosure with a colorant, and one or more additives such as surfactants, stabilizers, coagulants, waxes, surface additives, and optionally combinations thereof.

Colorants

The copolymer resin particles produced as described above, which may, in embodiments, be in the form of a latex, may be added to a colorant to produce a toner. In embodiments the colorant may be in a dispersion. The colorant dispersion may include, for example, submicron colorant particles having a size of, for example, from about 50 to about 500 nanometers in volume average diameter and, in embodiments, of from about 100 to about 400 nanometers in volume average diameter. The colorant particles may be suspended in an aqueous water phase containing an anionic surfactant, a nonionic surfactant, or combinations thereof. Suitable surfactants include any of those surfactants described above. In embodiments, the surfactant may be ionic and may be present in a dispersion in an amount from about 0.1 to about 25 percent by weight of the colorant, and in embodiments from about 1 to about 15 percent by weight of the colorant.

Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet, and/or combinations thereof.

In embodiments wherein the colorant is a pigment, the pigment may be, for example, carbon black, phthalocyanines, quinacridones or RHODAMINE B™ type, red, green, orange, brown, violet, yellow, fluorescent colorants, and the like.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigment magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra(octadecyl sulfonamido)phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, combinations of any of the foregoing, and the like. The dyes may be utilized in various suitable amounts, for example from about 0.5 to about 20 percent by weight of the toner, in embodiments, from about 5 to about 18 weight percent of the toner.

In embodiments, colorant examples include Pigment Blue 15:3 having a Color Index Constitution Number of 74160, Magenta Pigment Red 81:3 having a Color Index Constitution Number of 45160:3, Yellow 17 having a Color Index Constitution Number of 21105, and known dyes such as food dyes, yellow, blue, green, red, magenta dyes, and the like.

In other embodiments, a magenta pigment, Pigment Red 122 (2,9-dimethylquinacridone), Pigment Red 185, Pigment Red 192, Pigment Red 202, Pigment Red 206, Pigment Red 235, Pigment Red 269, combinations thereof, and the like, may be utilized as the colorant.

The colorant may be present in the toner of the disclosure in an amount of from about 1 to about 25 percent by weight of toner, in embodiments in an amount of from about 2 to about 15 percent by weight of the toner.

The resulting copolymer resin latex, optionally in a dispersion, and colorant dispersion may be stirred and heated to a temperature of from about 35° C. to about 70° C., in embodiments of from about 40° C. to about 65° C., resulting in toner aggregates of from about 2 microns to about 10 microns in volume average diameter, and in embodiments of from about 5 microns to about 8 microns in volume average diameter.

Coagulants

In embodiments, a coagulant may be added during or prior to aggregating the emulsion and the aqueous colorant dispersion. The coagulant may be added over a period of time from about 1 minute to about 60 minutes, in embodiments from about 1.25 minutes to about 20 minutes, depending on the processing conditions.

Examples of suitable coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, combinations thereof, and the like. One suitable coagulant is PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to contain the formula $Al_{13}O_4(OH)_{24}(H_2O)_{12}$ with about 7 positive electrical charges per unit.

In embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.01 to about 5 percent by weight of the toner, and in embodiments from about 0.1 to about 3 percent by weight of the toner.

Wax

Wax dispersions may also be added during formation of a latex or toner in an emulsion aggregation synthesis. Suitable waxes include, for example, submicron wax particles in the size range of from about 50 to about 1000 nanometers, in embodiments of from about 100 to about 500 nanometers in volume average diameter, suspended in an aqueous phase of water and an ionic surfactant, nonionic surfactant, or combinations thereof. Suitable surfactants include those described above. The ionic surfactant or nonionic surfactant may be present in an amount of from about 0.1 to about 20 percent by weight, and in embodiments of from about 0.5 to about 15 percent by weight of the wax.

The wax dispersion according to embodiments of the present disclosure may include, for example, a natural vegetable wax, natural animal wax, mineral wax, and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and combinations thereof.

Examples of polypropylene and polyethylene waxes include those commercially available from Allied Chemical and Baker Petrolite, wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasel K.K., and similar materials. In embodiments, commercially available polyethylene waxes possess a molecular weight (Mw) of from about 100 to about 5000, and in embodiments of from about 250 to about 2500, while the commercially available polypropylene waxes have a molecular weight of from about 200 to about 10,000, and in embodiments of from about 400 to about 5000.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, JONCRYL 74, 89, 130, 537, and 538, all available from Johnson Diversey, Inc, or chlorinated polypropylenes and polyethylenes commercially available from Allied Chemical, Baker Petrolite Corporation and Johnson Diversey, Inc.

The wax may be present in an amount of from about 0.1 to about 30 percent by weight, and in embodiments from about 2 to about 20 percent by weight of the toner.

Aggregating Agents

Any aggregating agent capable of causing complexation might be used in forming toners of the present disclosure. Both alkali earth metal or transition metal salts can be utilized as aggregating agents. In embodiments, alkali (II) salts can be selected to aggregate latex resin colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally combinations thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, combinations thereof, and the like.

pH Adjustment Agent

In some embodiments a pH adjustment agent may be added to the latex, colorant, and optional additives, to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof.

The resultant blend of latex, optionally in a dispersion, stabilizer, optional wax, colorant dispersion, optional coagulant, and optional aggregating agent, may then be stirred and heated to a temperature below the $T_g$ of the latex, in embodiments from about 30° C. to about 70° C., in embodiments of from about 35° C. to about 65° C., for a period of time of from about 0.2 hours to about 6 hours, in embodiments from about 0.3 hours to about 5 hours, to form aggregated particles.

In embodiments, an optional shell may then be formed on the aggregated particles, prior to coalescence. Where used, the shell latex may be applied by any method within the purview of those skilled in the art, including dipping, spraying, and the like. In embodiments, a shell may be applied by adding additional latex to the aggregated particles and allowing this additional latex to aggregate on the surface of the particles, thereby forming a shell thereover. Any resin within the purview of those skilled in the art, including those resins described above, may be utilized as a shell latex. In embodiments, a styrene-n-butyl acrylate copolymer may be utilized to form the shell latex. In embodiments, the latex utilized to form the shell may have a glass transition temperature of from about 35° C. to about 75° C., in embodiments from about 40° C. to about 70° C.

The shell latex may be applied until the desired final size of the toner particles is achieved, in embodiments from about 2 microns to about 10 microns, in other embodiments from about 4 microns to about 8 microns.

Once the desired final size of the toner particles is achieved, the pH of the mixture may be adjusted with a base to a value of from about 3.5 to about 7, and in embodiments from about 4 to about 6.5. The base may include any suitable base such as, for example, alkali metal hydroxides such as, for example, sodium hydroxide, potassium hydroxide, and ammonium hydroxide. The alkali metal hydroxide may be added in amounts from about 0.1 to about 30 percent by weight of the mixture, in embodiments from about 0.5 to about 15 percent by weight of the mixture.

Coalescence

The aggregated particles are subsequently coalesced. Coalescing may include stirring and heating at a temperature of from about 65° C. to about 99° C., for a period of from about 0.5 to about 12 hours, and in embodiments from about 1 to about 6 hours. Coalescing may be accelerated by additional stirring.

In embodiments, a transition metal powder and/or a transition metal salt may be added to the mixture of latex, colorant, optional wax, and any additives, at the beginning of the coalescence process. Suitable metals include, for example, copper, zinc, iron, cobalt, nickel, molybdenum, manganese, chromium, vanadium, and/or titanium, as well as metal alloys such as copper/zinc alloys.

Subsequent Treatments

In embodiments, the pH of the mixture may then be lowered to from about 3.5 to about 6 and, in embodiments, to from about 3.7 to about 5.5 with, for example, an acid, to further coalesce the toner aggregates. Suitable acids include, for example, nitric acid, sulfuric acid, hydrochloric acid, citric acid and/or acetic acid. The amount of acid added may be from about 0.1 to about 30 percent by weight of the mixture, and in embodiments from about 1 to about 20 percent by weight of the mixture.

The mixture may be cooled, washed and dried. Cooling may be at a temperature of from about 20° C. to about 40° C., in embodiments from about 22° C. to about 30° C., over a period of time of from about 1 hour to about 8 hours, in embodiments from about 1.5 hours to about 5 hours.

In embodiments, cooling a coalesced toner slurry may include quenching by adding a cooling media such as, for example, ice, dry ice and the like, to effect rapid cooling to a temperature of from about 20° C. to about 40° C., in embodiments of from about 22° C. to about 30° C. Quenching may be feasible for small quantities of toner, such as, for example, less than about 2 liters, in embodiments from about 0.1 liters to about 1.5 liters. For larger scale processes, such as for example greater than about 10 liters in size, rapid cooling of the toner mixture may be carried out by passing the coalesced toner slurry through a heat-exchanging device to reduce its temperature to from about 20° C. to about 40° C.

The toner slurry may then be washed. The washing may be carried out at a pH of from about 7 to about 12, in embodiments at a pH of from about 9 to about 11. The washing may be at a temperature of from about 20° C. to about 70° C., in embodiments from about 25° C. to about 67° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

Drying may be carried out at a temperature of from about 20° C. to about 75° C., and in embodiments of from about 45° C. to about 60° C. The drying may be continued until the moisture level of the particles is below a set target of about 1% by weight, in embodiments of less than about 0.7% by weight.

As noted above, the copolymers of the present disclosure may be utilized to form toners by processes having low energy requirements, e.g., temperature processing, through the application of pressure. For example, an aqueous suspension of the previously described nanoparticles as a latex, a pigment dispersion, and a wax dispersion, may be aggregated with poly(aluminum chloride) at a pH of from about 2 to about 4, in embodiments from about 2.2 to about 3, and a temperature of from about 20° C. to about 60° C., in embodiments from about 35° C. to about 55° C., to produce particles of a size from about 3 to about 20 μm, in embodiments from about 4 to about 10 μm, depending on the final application. The suspension could then be treated with alkali and a chelating agent to arrest particle growth and heated at from about 60° C. to about 99° C., in embodiments from about 70° C. to about 98° C., in embodiments about 95° C., to coalesce the toner particles. The resulting slurry could then be filtered, washed, and dried to produce dry toner particles. The resulting toner particles may be xerographically printed and pressure-fixable at pressures of from about 500 psi (about 3.5 MPa) to about 10,000 psi (about 69 MPa), in embodiments from about 1000 psi (about 3.5 MPa) to about 7,000 psi (about 48 MPa), in embodiments about 5,000 psi (about 35 MPa), to provide robust images.

Other Additives

In embodiments, the toner particles may also contain other optional additives, as desired or required. For example, the toner may include positive or negative charge control agents, for example in an amount of from about 0.1 to about 10 percent by weight of the toner, in embodiments from about 1 to about 3 percent by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts including such as BONTRON® E-84 or BONTRON® E-88 (Hodogaya Chemical); combinations thereof, and the like. BONTRON® E-84 is a zinc complex of 3,5-di-tert-butylsalicylic acid in powder form. BONTRON® E-88 is a mixture of hydroxyaluminum-bis[2-hydroxy-3,5-di-tert-butylbenzoate] and 3,5-di-tert-butylsalicylic acid.

There can also be blended with the toner particles external additive particles including flow aid additives, which additives may be present on the surface of the toner particles. Examples of these additives include metal oxides such as titanium oxide, titanium dioxide, silicon oxide, silicon dioxide, tin oxide, mixtures thereof, and the like; colloidal and amorphous silicas, such as AEROSIL®, metal salts and metal salts of fatty acids inclusive of zinc stearate, strontium stearate, calcium stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner. Suitable additives include those disclosed in U.S. Pat. Nos. 3,590,000, 3,800,588, and 6,214,507, the disclosures of each of which are hereby incorporated by reference in their entirety.

These additional additives may be present in an amount from about 0.05% to about 1% by weight of the toner, in embodiments from about 0.1% to about 0.5% by weight of the toner. Other additives may also be used in the blend depending upon the desired performance and hardware interactions.

The above surface additives may be utilized to optimize charging and charge distribution of a toner. Toners of the present disclosure may have a triboelectric charge at from about −10 μC/g to about −90 μC/g, in embodiments from about −20 μC/g to about −80 μC/g.

Toner Particles

Toners produced in accordance with the present disclosure may possess excellent charging characteristics when exposed to extreme relative humidity (RH) conditions. The low-humidity zone (C zone) is about 10° C./15% RH, while the high humidity zone (A zone) is about 28° C./85% RH. Toners of the present disclosure may also possess a parent toner charge per mass ratio (QIM) of from about −3 μC/g to about −35 μC/g, and a final toner charging after surface additive blending of from −5 μC/g to about −50 μC/g.

Toners of the present disclosure may provide xerographic images that can be fused at room temperature under pressures of from about 500 psi and 5,000 psi, in embodiments from about 1,000 psi to about 4,000 psi, that when subjected to a crease fix test provide a crease area of about 80 units or less, in embodiments from about 10 units to about 80 units, and 75-degree gloss of from about 30 Gardner gloss units (ggu) to about 80 ggu, in embodiments from about 40 ggu to about 70 ggu.

Particles of a toner of the present disclosure may have a volume average diameter of from about 4 microns to about 8 microns, in embodiments from about 5 microns to about 7 microns, depending on application. The number average geometric size distribution (GSDn) and/or Volume Average Geometric Size Distribution (GSDv) of a toner of the present disclosure may be from about 1.1 to about 1.35, in embodiments from about 1.15 to about 1.25, as determined by a Beckman Coulter Multisizer.

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

Particles of a toner of the present disclosure may have a circularity of from about 0.9 to about 0.99 (measured with, for example, a Sysmex FPIA 2100 analyzer).

Uses

Toner in accordance with the present disclosure can be used in a variety of imaging devices including printers, copy machines, and the like. The toners generated in accordance with the present disclosure are excellent for imaging processes, especially electrophotographic processes such as electrophotographic processes, which may operate with a toner transfer efficiency in excess of about 90 percent, such as those with a compact machine design without a cleaner or those that are designed to provide high quality colored images with excellent image resolution, acceptable signal-to-noise ratio, and image uniformity. Further, toners of the present disclosure can be selected for electrophotographic imaging and printing processes such as digital imaging systems and processes.

The imaging process includes the generation of an image in an electronic printing apparatus and thereafter developing the image with a toner composition of the present disclosure. The formation and development of images on the surface of photoconductive materials by electrostatic means is within the purview of those skilled in the art. The basic electrophotographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material referred to in the art as "toner". The toner will normally be attracted to the discharged areas of the layer, thereby forming a toner image corresponding to the latent electrostatic image. This powder image may then be transferred to a support surface such as paper. The transferred image may subsequently be permanently affixed to the support surface as by heat.

Development may occur via discharge area development. In discharge area development, the photoreceptor is charged and then the areas to be developed are discharged. The development fields and toner charges are such that toner is repelled by the charged areas on the photoreceptor and attracted to the discharged areas. This development process is used in laser scanners.

In other embodiments, development may also be accomplished by the magnetic brush development process disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer comprises conductive carrier particles and is capable of conducting an electric current between the biased magnet through the carrier particles to the photoreceptor.

Imaging

Imaging methods are also envisioned with the toners disclosed herein. Such methods include, for example, some of the above patents mentioned above and U.S. Pat. Nos. 4,265,990, 4,858,884, 4,584,253 and 4,563,408, the disclosures of each of which are hereby incorporated by reference in their entirety. The imaging process includes the generation of an image in an electronic printing magnetic image character recognition apparatus and thereafter developing the image with a toner composition of the present disclosure. The formation and development of images on the surface of photoconductive materials by electrostatic means is within the purview of those skilled in the art. The basic electrophotographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

In embodiments, fixing may be accomplished by the application of pressure as described above to allow for application and processing of the baroplastic materials.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

Synthesis of block co-polymer latex. A polystyrene/poly (butyl acrylate) block co-polymer is prepared as follows. About 65 parts styrene and 5 parts beta-carboxyethyl acrylate are dissolved in toluene along with approximately 1 part methyl 2-bromoproprionate and catalytic amounts of CuCl and pentamethyl-diethylenetriamine. The reaction mixture is heated to approximately 100° C. with stirring under a nitrogen atmosphere. When no free monomer remains in the solution, the temperature is lowered to approximately 80° C. and a further 30 parts n-butyl acrylate are added. After polymerization, the reaction mixture is filtered through alumina and diluted into methanol to precipitate the solid polymer product.

The block co-polymer product is formed into a latex as follows. About 100 parts polymer is dissolved in approximately 700 parts ethyl acetate and the resulting solution is heated to approximately 60° C. with stirring. Separately, 6 parts Dowfax 2A1 surfactant solution, 2 parts sodium bicarbonate, and 550 parts deionized water are heated to approximately 60° C. with stirring. The ethyl acetate solution is then added to the aqueous solution over a period of approximately one minute, while mixing the solution with an IKA Ultra-Turrax homogenizer at a speed of 4,000 (initial) to 10,000 (final) rpm. Mixing is continued at 10,000 rpm for 30 minutes, after which the remaining ethyl acetate is removed by distillation at ambient pressure.

Example 2

Synthesis of block co-polymer latex. A polystyrene/poly (ethylhexyl acrylate) block co-polymer is prepared as follows. About 65 parts styrene and 5 parts beta-carboxyethyl acrylate are dissolved in toluene along with approximately 1 part methyl 2-bromoproprionate and catalytic amounts of CuCl and pentamethyl-diethylenetriamine. The reaction mixture is heated to approximately 100° C. with stirring under a nitrogen atmosphere. When no free monomer remains in the solution, the temperature is lowered to approximately 80° C. and a further 30 parts ethylhexyl acrylate are added. After polymerization, the reaction mixture is filtered through alumina and diluted into methanol to precipitate the solid polymer product.

The block co-polymer product is formed into a latex as follows. About 100 parts polymer is dissolved in approximately 700 parts ethyl acetate and the resulting solution is heated to approximately 60° C. with stirring. Separately, 6 parts Dowfax 2A1 surfactant solution, 2 parts sodium bicarbonate, and 550 parts deionized water are heated to approximately 60° C. with stirring. The ethyl acetate solution is then added to the aqueous solution over a period of approximately one minute, while mixing the solution with an IKA Ultra-Turrax homogenizer at a speed of 4,000 (initial) to 10,000

(final) rpm. Mixing is continued at 10,000 rpm for 30 minutes, after which the remaining ethyl acetate is removed by distillation at ambient pressure.

Example 3

Synthesis of block co-polymer latex. A polystyrene/poly (cyclohexyl acrylate) block co-polymer is prepared as follows. About 65 parts styrene and 5 parts beta-carboxyethyl acrylate are dissolved in toluene along with approximately 1 part methyl 2-bromoproprionate and catalytic amounts of CuCl and pentamethyl-diethylenetriamine. The reaction mixture is heated to approximately 100° C. with stirring under a nitrogen atmosphere. When no free monomer remains in the solution, the temperature is lowered to approximately 80° C. and a further 30 parts cyclohexyl acrylate are added. After polymerization, the reaction mixture is filtered through alumina and diluted into methanol to precipitate the solid polymer product.

The block co-polymer product is formed into a latex as follows. About 100 parts polymer is dissolved in approximately 700 parts ethyl acetate and the resulting solution is heated to approximately 60° C. with stirring. Separately, 6 parts Dowfax 2A1 surfactant solution, 2 parts sodium bicarbonate, and 550 parts deionized water are heated to approximately 60° C. with stirring. The ethyl acetate solution is then added to the aqueous solution over a period of approximately one minute, while mixing the solution with an IKA Ultra-Turrax homogenizer at a speed of 4,000 (initial) to 10,000 (final) rpm. Mixing is continued at 10,000 rpm for 30 minutes, after which the remaining ethyl acetate is removed by distillation at ambient pressure.

Comparative Example 1

Synthesis of standard polymer latex. A polystyrene/poly (butyl acrylate) random co-polymer latex was prepared as follows. A mixture of 490 parts styrene, 110 parts n-butyl acrylate, 12 parts acrylic acid, 6 parts carbon tetrabromide and 18 parts dodecanethiol were added to an aqueous solution prepared from 6 parts ammonium persulfate in 200 parts water and 700 parts of an aqueous solution containing 13.5 parts of anionic surfactant, NEOGEN R™ and 13 parts nonionic surfactant, ANTAROX CA 897™. The resulting mixture was homogenized at room temperature of about 25° C. under a nitrogen atmosphere for 30 minutes. Subsequently, the mixture was stirred and heated to 70° C. at a rate of 1° C. per minute, and retained at this temperature for 6 hours. The resulting latex polymer of styrene-butylacrylate-acrylic acid composition possessed a weight-average molecular weight (Mw) of 25,900 g/mol and a number-average molecular weight (Mn) of 5,400 g/mol, as determined by GPC analysis with polystyrene standards, and a mid-point glass transition temperature of 55.9° C. as measured by DSC.

Example 4

Preparation of toner from block co-polymer latex. In a large flask, 600 parts water, the latex described in Example 1 corresponding to 110 parts block co-polymer, polyethylene wax dispersion corresponding to 20 parts wax, and cyan colorant dispersion corresponding to 12 parts Pigment Blue 15:3 are evenly mixed and then stirred at 4,000 rpm using an IKA Ultra-Turrax homogenizer. About 0.2 parts polyaluminum chloride) are added dropwise and with continued homogenization, after which the resulting mixture is heated from room temperature to approximately 45° C. at a rate of 1° C. per minute with stirring at about 300 RPM. A further quantity of the latex described in Example 1 (corresponding to 55 parts block co-polymer) is added with continued heating. When the volume-average particle size reaches approximately 6 μm, approximately 5 parts DOW Versene 100 solution are added and the pH of the solution is adjusted to 5.5. The reaction temperature is raised to 95° C. and maintained at this temperature for a total of 3 hours. Particle shape is monitored during this time using a Sysmex FPIA 2100; when the shape factor reaches 0.96, the pH of the solution is adjusted to 7. After cooling to room temperature, the toner slurry is passed through a sieve of 25-μm pore size, filtered, then re-suspended in water and re-filtered a total of three times before drying.

Example 5

Preparation of toner from block co-polymer latex. A process identical to Example 4 is used, except that the polystyrene-block-poly(ethylhexyl acrylate)-based copolymer of Example 2 is used to form the toner.

Example 6

Preparation of toner from block co-polymer latex. A process identical to Example 4 is used, except that the polystyrene-block-poly(cyclohexyl acrylate)-based copolymer of Example 3 is used to form the toner.

Comparative Example 2

Preparation of toner from random co-polymer latex. The procedure of Example 4 was followed, replacing the block co-polymer latex of Example 1 with the random co-polymer latex of Comparative Example 1. After xerographic printing on standard paper, this toner failed to provide acceptable fix (as measured by the known Crease Fix Test) under the influence of 5,000 psi of pressure alone.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner comprising:

a baroplastic resin comprising a block copolymer comprising at least one soft segment in combination with at least one hard segment; and one or more ingredients selected from the group consisting of colorants, waxes, coagulants, and combinations thereof.

2. The toner according to claim 1, wherein the at least one soft segment is selected from the group consisting of poly (butyl acrylate), poly(ethyl acrylate), poly(propyl acrylate), poly(hexyl acrylate), poly(ethylhexyl acrylate), poly(benzyl acrylate), poly(cyclohexyl acrylate), and combinations thereof.

3. The toner according to claim 1, wherein the at least one hard segment is selected from the group consisting of polystyrene, poly(methyl methacrylate), poly(ethyl methacrylate), poly(cyclohexyl methacrylate), and combinations thereof.

4. The toner of claim 1, wherein the copolymer comprises a styrene/butyl acrylate block copolymer, and wherein the resin further comprises a shell over the particle core.

5. The toner of claim 4, wherein the copolymer further comprises beta carboxyethyl acrylate.

6. The toner of claim 5, wherein the polystyrene block forms a core of the resin particle, the polybutyl acrylate block forms an inner shell over the core, and the beta carboxyethyl acrylate forms an outer shell over the polybutyl acrylate.

7. The toner of claim 5, wherein the polybutyl acrylate block forms a core of the resin particle, the polystyrene block forms an inner shell over the core, and the beta carboxyethyl acrylate forms an outer shell over the polystyrene.

8. The toner according to claim 1, wherein the coagulant is selected from the group consisting of aluminum salts, polyaluminum halides, polyaluminum silicates, polyaluminum hydroxides, polyaluminum phosphates, and combinations thereof, the wax is selected from the group consisting of a polyethylene wax, a polypropylene wax, and combinations thereof, and is present in an amount of from about 0.1 percent to about 30 percent by weight of the toner, and the colorant includes a pigment, a dye, and combinations thereof, in an amount of from about 1 percent to about 25 percent by weight of the toner.

9. The toner of claim 1, wherein the toner possesses a triboelectric value of from about 40 μC/g to about 90 μC/g, a circularity from about 0.9 to about 0.99, and a surface area from about 0.8 $m^2/g$ to about 3.5 $m^2/g$.

10. The toner of claim 1, wherein the block copolymer composition exhibits Newtonian flow at a processing temperature that is less than 150° C. upon applying a pressure of at least about 100 psi, and wherein the composition does not exhibit Newtonian flow at the processing temperature in the absence of said pressure.

11. The toner of claim 1, wherein the block copolymer possesses a pressure coefficient that favors miscibility, defined as a change in temperature of the disorder-order transition, $T_{DOT}$, of the block copolymer, as a function of change in pressure, $P(d\ T_{DOT}/dP)$, of the block copolymer, with an absolute value greater than about 30° C./kbar.

* * * * *